US012495923B2

(12) United States Patent
Olsen et al.

(10) Patent No.: US 12,495,923 B2
(45) Date of Patent: Dec. 16, 2025

(54) WHEEL SYSTEM, KIT AND METHOD

(71) Applicant: Bannack Medical LLC, Gilbert, AZ (US)

(72) Inventors: Arlen Olsen, Clifton Park, NY (US); Joel Price, Germantown, MD (US)

(73) Assignee: BANNACK MEDICAL LLC, Gilbert, AZ (US)

( * ) Notice: Subject to any disclaimer, the term of this patent is extended or adjusted under 35 U.S.C. 154(b) by 201 days.

(21) Appl. No.: 17/510,864

(22) Filed: Oct. 26, 2021

(65) Prior Publication Data

US 2023/0127236 A1 Apr. 27, 2023

Related U.S. Application Data

(63) Continuation-in-part of application No. 17/510,787, filed on Oct. 26, 2021, now Pat. No. 12,144,452.

(51) Int. Cl.

| | |
|---|---|
| ***A47H 13/00*** | (2006.01) |
| ***A47H 1/06*** | (2006.01) |
| ***A47H 15/04*** | (2006.01) |
| *A47H 23/10* | (2006.01) |

(52) U.S. Cl.

CPC ..... *A47H 13/00* (2013.01); *A47H 1/06* (2013.01); *A47H 15/04* (2013.01); *A47H 23/10* (2013.01)

(58) Field of Classification Search

CPC ..... A47H 13/00; A47H 1/06; A47H 15/04; A47H 23/10; A47H 15/02

See application file for complete search history.

(56) References Cited

U.S. PATENT DOCUMENTS

| | | | |
|---|---|---|---|
| 1,571,394 | A | 2/1926 | Chalmer |
| 2,405,020 | A | 7/1946 | Dierking |
| 2,594,605 | A | 4/1952 | Zoppelt |

(Continued)

FOREIGN PATENT DOCUMENTS

| | | | |
|---|---|---|---|
| CH | 657511 | A5 | 9/1986 |
| CN | 107495816 | A | 12/2017 |

(Continued)

OTHER PUBLICATIONS

CubeCare: Cubicle Curtain Tracks for Hospitals and Medical Facilities: https://www.cubecare.com/products/cubicle-curtain-tracks/. 5 pages.

(Continued)

*Primary Examiner* — Jason W San
*Assistant Examiner* — Matthew J Sullivan
(74) *Attorney, Agent, or Firm* — Schmeiser, Olsen & Watts, LLP

(57) ABSTRACT

Disclosed is a wheel system and a kit and method, for use with a track, said wheel system comprising: a wheel carriage; a set of wheels, attached to the wheel carriage; —a link, having a first end, releasably attached to the wheel carriage and a second end releasably attached to an extension. Also, disclosed is a wheel system, for use with a track, the wheel system having a wheel carriage; a set of wheels, attached to the wheel carriage; —a link, having a first end, operatively attached to the wheel carriage; wherein angles of the wheels and the width of the wheel carriage are sized to fit into multiple sizes of tracks.

13 Claims, 12 Drawing Sheets

(56) References Cited

U.S. PATENT DOCUMENTS

| | | | | |
|---|---|---|---|---|
| 2,741,923 | A | 4/1956 | Bradley | |
| 2,968,205 | A | 1/1961 | Springate | |
| 3,107,947 | A | 10/1963 | Hulterstrum | |
| 3,142,858 | A * | 8/1964 | Bieda | A47H 15/04 160/346 |
| 3,585,674 | A | 6/1971 | Golden | |
| 3,616,486 | A | 11/1971 | Ford et al. | |
| 3,626,429 | A * | 12/1971 | Toder | A47H 13/00 24/669 |
| 3,971,601 | A | 7/1976 | Sytsma | |
| 4,023,235 | A | 5/1977 | Cohen et al. | |
| 4,102,007 | A * | 7/1978 | Janson | A47H 1/04 16/96 R |
| 4,141,106 | A | 2/1979 | Dixon | |
| 4,203,511 | A | 5/1980 | Uhing | |
| 4,228,738 | A | 10/1980 | Forshee | |
| 4,229,857 | A * | 10/1980 | Toder | A47H 15/02 16/98 |
| 4,282,630 | A | 8/1981 | Toder | |
| 4,302,865 | A | 12/1981 | Dixon et al. | |
| 4,576,096 | A | 3/1986 | Toder | |
| 4,643,238 | A * | 2/1987 | Tachikawa | E06B 9/307 160/178.1 R |
| 4,837,891 | A | 6/1989 | Toma et al. | |
| 4,915,153 | A | 4/1990 | Toti | |
| 5,016,318 | A | 5/1991 | Harris | |
| D379,060 | S | 5/1997 | Laga | |
| D379,427 | S | 5/1997 | Laga | |
| 6,098,695 | A * | 8/2000 | Schwingle | E05F 15/605 160/199 |
| 6,098,699 | A * | 8/2000 | Junius | A47H 15/04 160/330 |
| 6,564,851 | B1 * | 5/2003 | Liao | A47H 15/04 16/87.4 R |
| 6,618,900 | B2 * | 9/2003 | Spork | E05D 15/26 16/105 |
| D492,580 | S | 7/2004 | Tyburk et al. | |
| 6,820,306 | B2 | 11/2004 | Huang | |
| 6,938,927 | B1 | 9/2005 | Martin et al. | |
| 7,360,576 | B2 | 4/2008 | Lin | |
| 7,698,781 | B2 | 4/2010 | Cai | |
| 7,909,491 | B2 * | 3/2011 | Hoets | F21S 8/06 362/382 |
| 8,307,499 | B2 * | 11/2012 | Ruffo | A47H 13/00 160/178.1 V |
| 8,397,346 | B2 * | 3/2013 | Peters | A47H 5/14 16/95 D |
| 9,125,509 | B2 | 9/2015 | Graneto, III | |
| 9,320,379 | B2 | 4/2016 | Sourain et al. | |
| 9,458,654 | B2 | 10/2016 | Palsson et al. | |
| 9,480,357 | B2 | 11/2016 | Price et al. | |
| D795,157 | S | 8/2017 | Biesenbruck et al. | |
| 10,570,662 | B2 * | 2/2020 | Miroshnichenko | E04F 10/02 |
| 10,758,072 | B2 | 9/2020 | Hatton et al. | |
| 11,297,966 | B2 * | 4/2022 | Alonso | A47H 15/02 |
| 11,399,650 | B2 * | 8/2022 | Ko | A47H 1/06 |
| D962,751 | S | 9/2022 | Olsen et al. | |
| D962,752 | S | 9/2022 | Olsen et al. | |
| D962,753 | S | 9/2022 | Olsen et al. | |
| D982,422 | S | 4/2023 | Olsen et al. | |
| D1,011,869 | S | 1/2024 | Olsen et al. | |
| D1,012,551 | S | 1/2024 | Olsen et al. | |
| 2004/0117945 | A1 | 6/2004 | Huang | |
| 2005/0239588 | A1 | 10/2005 | Lin | |
| 2006/0001254 | A1 | 1/2006 | Malone | |
| 2007/0012346 | A1 | 1/2007 | Choi | |
| 2007/0136986 | A1 * | 6/2007 | Chen | E06B 9/323 16/91 |
| 2009/0288785 | A1 * | 11/2009 | Graneto, III | A47H 15/02 160/340 |
| 2010/0125987 | A1 * | 5/2010 | Barkun | A47H 13/00 24/716 |
| 2010/0139873 | A1 | 6/2010 | Gardner | |
| 2011/0283479 | A1 | 11/2011 | Peters et al. | |
| 2012/0018106 | A1 | 1/2012 | Robledo | |
| 2012/0037324 | A1 * | 2/2012 | Graneto, III | A47H 13/01 160/341 |
| 2012/0167350 | A1 | 7/2012 | Chou | |
| 2012/0198655 | A1 | 8/2012 | Lapping | |
| 2013/0047331 | A1 | 2/2013 | Parker et al. | |
| 2014/0026359 | A1 * | 1/2014 | Borgerding | A47H 15/02 16/88 |
| 2017/0231413 | A1 * | 8/2017 | Schöpfer | A47H 15/00 160/330 |
| 2017/0284155 | A1 * | 10/2017 | Ganzi | E06B 9/78 |
| 2018/0279818 | A1 | 10/2018 | Goelst | |
| 2020/0080367 | A1 * | 3/2020 | Daugaard | A47H 1/13 |
| 2022/0015564 | A1 * | 1/2022 | Olsen | A47H 13/04 |
| 2022/0015566 | A1 * | 1/2022 | Olsen | A47H 15/02 |
| 2022/0049546 | A1 * | 2/2022 | Daugaard | A47H 5/0325 |
| 2022/0240707 | A1 * | 8/2022 | Roberts | A47H 13/06 |
| 2022/0265078 | A1 * | 8/2022 | Hsu | A47H 15/04 |
| 2022/0275682 | A1 * | 9/2022 | Chuang | A47H 1/06 |
| 2022/0279954 | A1 * | 9/2022 | Olsen | A47H 13/04 |
| 2022/0322863 | A1 * | 10/2022 | Olsen | A47H 15/02 |
| 2023/0130071 | A1 * | 4/2023 | Olsen | A47H 1/06 16/107 |

FOREIGN PATENT DOCUMENTS

| | | | |
|---|---|---|---|
| CN | 108903569 | A | 11/2018 |
| DE | 102017010861 | A1 | 5/2019 |
| EP | 2428142 | A2 | 3/2012 |
| EP | 3308680 | A2 | 4/2018 |
| FR | 2333113 | B1 | 3/1981 |
| GB | 2358123 | A | 7/2001 |
| GB | 2385511 | A | 8/2003 |
| GB | 2457075 | B | 10/2011 |
| GB | 2489485 | A | 10/2012 |
| GB | 2493773 | A | 2/2013 |
| GB | 2515504 | A | 12/2014 |
| JP | 2002165698 | A | 6/2002 |
| JP | 3562672 | B2 | 9/2004 |
| JP | 2006314537 | A | 11/2006 |
| JP | 09189180 | A * | 8/2022 |

OTHER PUBLICATIONS

Covoc Corporation: Cubicle Track Accessories: https://www.covoc.com/accessories-2/. 4 pages.

Inpro: Optitrac ball chain carrier: https://www.inprocorp.com/products/privacysystems/cubicle-curtaintrack-andaccessories/optitrac-ballchain-carrier/. 6 pages.

Medline Industries, Inc.: Standard Supreme Cubicle Curtain Tracks and Accessories: https://punchout.medline.com/product/Standard-Supreme-Cubicle-Curtain-Tracks-by-Imperial-Fastener/Parts/Z05-PF184262?question=&index=P4&indexCount=4. 1 page.

Curtain-Tracks.com: 7191 Privacy Cubicle Carrier or Roller w/ Hook (14/bag): https://www.curtain-tracks.com/privacy-cubicle-roller.html. 1 page.

Tru-Roll: Tru-Roll Track Carrier: https://truroll.com/wp-content/uploads/2014/12/TruRoll-2017-Catalog-Ed1.pdf. 35 pages.

ALCO sales & Service Co.: Cubicle Track Carriers: https://www.alcosales.com/images/50178.pdf. 3 pages.

HAIGuard: Break-Away Carrier (Model CC-1003): Retrieved from https://haiguard.com/track-systems/aluminum-track-system/. 1 page.

Rhinocats: Rear Runner Curtain Runner Rear Holder Roller Diameter 0.2 inches (5.5 mm), Silent, Lightweight Type, Compatible with Square and C Types, Supports Groove Width 0.2-0.3 inches (6-8 mm): https://www.amazon.co.jp/-/en/RHINOCATS-Diameter-Lightweight-Compatible-Supports/dp/B07VBQZPGJ/ref=zg_bs_2157258051_13/357-55745202158114?_encoding=UTF8&refRID=V5JNTS7TXJ1ND4KYTA9M&th=1. 1 page.

Chuang beauty: Window Bijin RUN-ATO10P Rear Curtain Runners: https://www.amazon.co.jp/Window-Bijin-RUN-ATO10P-Curtain-Runners/dp/B00MXQQBK2/ref=pd_day0_7/357-5574520-2158114?pd_rd_w=7h0a4&pf_rd_p-fab5dbe4-f0e5-4fa4-b9db-f6338912edc6&pf_rd _r=RGFESP3XWG01DFXFGDMX&pd_rd_

(56) References Cited

OTHER PUBLICATIONS r=364e4a2e-3050-44ba-80e5-ee9eb1fa6054&pd_rd_wg=nA6IW&pd_rd_i=B00MXQQBK2&psc=1#HL CXComparisonWidget_feature_div. 3 pages.
Rod Desyne: Ball Bearing Carrier with Stainless hooks for Multi-Purpose Room Divider Track: https://www.homedepot.com/p/Rod-Desyne-Ball-Bearing-Carrier-with-Stainless-hooks-for-Multi-Purpose-Room-Divider-Track-Set-of-10-AUC1931/303506245. 4 pages.
VRSS: flexible bendable straight curved shower curtains track for I and u shape bay windows with instruction mounting accessories include (3m): https://www.amazon.in/VRSS-Flexible-Bendable-Instruction-Accessories/dp/B06XDZSV26. 4 pages.
Curtain Track: 6018 metal block carrier with nylon wheels: https://www.curtain-tracks.com/6018-metal-block-carrier.html. 6 pages.
Medical Products Direct: Flexible Curtain Track, Nylon Carrier with Hook: https://www.medicalproductsdirect.com/flexible-curtain-track-nylon-carrier-10-pack.html. 3 pages.
DFB Sales: Draperies for Business: https://www.dfbsales.com/wp-content/uploads/2019/03/Drapery_DFB.pdf. 16 pages.
Covoc: Covoc 9038 Carrier With Canted Wheels and Bead Chain and Hook: https://www.covoc.com/covoc-9038-carrier-with-canted-wheels-and-bead-chain-and-hook/. 3 pages.
Walcot House: Curtain hook: Retrieved from: https://www.google.com/search?q=%22walcot+house%22+%22curtain+hook%22&sa=X&bih=657&biw=1366&rlz=10%20OKWM_enIN917IN91%207&hl=enUS&tbm=isch&source=iu&ictx=1&fir=m5qKZwWcxS3QTM%252CDAshTnOZvITjWM%252C_&vet=1&usg=AI4_-kTxnEcGZUJMofhaVVEdu7NmGIhmRQ&ved=2ahUKEwi2u62Hwuzy%20AhXHQ30KHVzkDgMQ9QF6BAgIEAE#imgrc=JTSjeC4MgLAp8M. 1 page.
Yap, Jules. "Hack a ceiling track for shower curtain", IKEAHackers; https://ikeahackers.net/2013/10/hack-a-ceiling-track-for-shower-curtain.html; Oct. 17, 2013. 6 pages.
Jasan, Afzal. Patentability Search Report for Adjustable Wheel for use in Tracks for Medical Curtains, dated Apr. 16, 2021.
Hasan, Afzal. Patentability Search Report (Updated) for Adjustable Wheel for use in Tracks for Medical Curtains, dated Sep. 16, 2021.
Restriction Requirement (Mail Date Dec. 28, 2022) for PCT International Application No. PCT/US22/46934—International Filing Date Oct. 18, 2022.
PCT International Search Report and Written Opinion of International Searching Authority mailed Mar. 15, 2023 corresponding to PCT International Application No. PCT/US22/46934 filed Oct. 18, 2022.
Notice of Allowance (Mail Date Mar. 27, 2023) for U.S. Appl. No. 29/813,033, filed Oct. 26, 2021.
Notice of Allowance (Mail Date Mar. 27, 2023) for U.S. Appl. No. 29/813,043, filed Oct. 26, 2021.
Office Action (Mail Date Jun. 7, 2023) for U.S. Appl. No. 29/813,043, filed Oct. 26, 2021.
Notice of Allowance (Mail Date Mar. 24, 2023) for U.S. Appl. No. 29/813,057, filed Oct. 26, 2021.
Office Action (Mail Date Oct. 2, 2023) for U.S. Appl. No. 17/510,787, filed Oct. 26, 2021.
Final Office Action (Mail Date Oct. 2, 23) for U.S. Appl. No. 29/813,043, filed Oct. 26, 2021.
InControl—SmartGuard Disposable Privacy Curtains; ttp://globalmedics.co.nz/media//InControl_SmartGuard_Brochure_2.pdf. 12 Pages.
Marlux Disposable Hospital Curtains: https://www.marluxmedical.com/disposable-curtains. 8 pages.
Opal Health Disposible Curtains Quick Fit System, May 26, 2017. https://www.youtube.com/watch?v=XsQnyL-REhY.
Opalhealth: The Fast, hygienic alternative to traditional curtains. https://opalhealth.co.uk/benefits/. 4 pages.
Solent Blinds & Curtains: Disposable Curtains: https://solentblinds.co.uk/commercial/products/disposable-curtains/. 1 page.
EasyClick: "The Next Generation of Disposable Curtains". https://behrens.co.uk/product/easyclick-the-next-generation-of-disposable-curtains/. 2 pages.
Installing Locking Button in Telescoping Tube, Jul. 29, 2014. https://www.youtube.com/watch?v=y3V6o3eca0g.
Halder: Ball Lock Pins self-locking, with T-handle. https://www.halder.com/eng/Products/Standard-Parts/Machine-and-Fixture-Elements/Ball-Lock-Pins/Ball-Lock-Pins-self-locking-with-T-handle. 2 pages.
Rapid Refresh Shower Curtains. https://www.icpmedical.com/docs/product-sheets/Shower-Curtains-RR.pdf. 1 page.
ICP Medical: Privacy Curtains: https://icpmedical.com/docs/product-sheets/Privacy-Curtains-RR.pdf. 2 pages.
EasyClick Disposable Cubicle Curtains. https://behrens.co.uk/media/EASYCLICK-advert.jpg; 1 page.
EasyKlip Instructions. Retrieved from https://www.curtain-tracks.com/610-easyklip-mini-tarp-clip-10-per-pack.html. 1 page.
EasyKlip Midi Tarp & Banner Clip. https://www.curtain-tracks.com/610-easyklip-mini-tarp-clip-10-per-pack.html. 2 pages.
"Halder Ball Lock Pins", Oct. 23, 2017. https://youtu.be/qLTZiNngk9c.
ICP Medical: Privacy Curtains: https://www.icpmedical.com/Products/Privacy-Curtains. 2 pages.
"Installing the ICP Medical Rapid Refresh Privacy Curtain", Jun. 10, 2014. https://www.youtube.com/embed azsr7bpMB5U?autoplay=1.
"Installing the ICP Medical Rapid Refresh Curtain Rods", Jun. 10, 2014. https://www.youtube.com/embed/lohmn8UhiRo?autoplay=1.
Hasan, Afzal. Patentability Search Report for Disposable Curtain System, dated Jul. 6, 2020.

* cited by examiner

WHEEL SYSTEM, KIT AND METHOD

CROSS-REFERENCE TO RELATED APPLICATIONS

This application is a continuation-in-part of U.S. application Ser. No. 17/510,787 filed on Oct. 26, 2021, and is related to U.S. application Ser. No. 17/225,321 filed on Apr. 8, 2021; U.S. application Ser. No. 17/011,571 filed on Sep. 3, 2020; U.S. application Ser. No. 17/004,625 filed on Aug. 27, 2020; and U.S. application Ser. No. 16/933,545 filed on Jul. 20, 2020 which all disclosures are hereby incorporated by reference in their entireties.

FIELD OF THE INVENTION

Disclosed is a wheel system, kit and method. In particular, is a wheel system having preassembled wheels and kit most often for use with an extension or quick connect for curtains, and most often, for use in health care facilities to maintain a clean environment.

BACKGROUND

Health care facilities, such as hospitals, nursing homes, doctor's offices, urgent care facilities, and long-term care facilities are becoming more and more concerned with infectious diseases being present. The COVID-19 pandemic is one major infectious disease that has brought attention to the public by the media to the concerns of cleanliness of health care facilities and other public spaces. In addition to COVID-19 are other infections diseases such as bacterial infection diseases like Anthrax, bacterial botulism, brucellosis, cholera, diphtheria, Lyme's disease, tuberculosis; fungal infectious diseases like aspergillosis, blastomycosis, candidiasis, cryptococcosis, histoplasmosis; parasitic infectious diseases like ascariasis, cryptosporidiosis, giardiasis, malaria, scabies; prion infectious diseases like Alper's syndrome, Creutzfeldt-Jakob disease, kuru; and viral infectious diseases like COVID-19, AIDS, chickenpox, Common Cold, Ebola, herpes, Influenza, mumps, rabies, rubella, viral meningitis, yellow fever and many more.

One location in the hospital that has a concern with infectious disease are the privacy curtains in locations such as the Emergency Room ("ER") and Intensive Care Unit ("ICU"). Medical personnel will take many precautions such as washing hands, wearing gloves and wearing personal protection equipment. However, while wearing gloves they will grab the curtains with their gloved hands which may leave infectious diseases on the curtains due to contact with bodily fluids such as blood, saliva, urine, mucous, phlegm, etc. In addition, patients which are surrounded by the curtain systems will cough, sneeze or perform other bodily functions which expel airborne liquids into the air surrounding their bed or private space.

Curtain systems for hospitals are generally attached to the ceiling. The curtains systems have a track which is affixed to the ceiling. Within the track are rollers, guides or wheels.

A difficulty with this system is that the tracks and hooks are attached to ceilings that can be from 7 to 12 feet above the floor. This requires maintenance personnel at the hospital to use ladders or other stools to replace the curtains.

A further difficulty is when replacing the curtain system, the wheels, guides or rollers have hooks which many times need to be crimped causing repetitive problems with the installer having problems with muscles and tendons due to repetitive installation of the curtains on the hooks.

Another difficulty is that the most curtain systems are not easily and quickly disassembled and require personnel to remove the curtains, one hook at a time.

Another difficulty is that the track generally is sold separately or are already existing and thus when installing the elongate member or extension and quick release requires extensive work that needs to be done to attach the system in-situ while the installer is on a ladder.

Another difficulty is that the tracks come in multiple sizes. The individual installing or replacing of the wheel systems needs to be selected from multiple sizes of wheels to fit the appropriate track.

Another difficulty is that hooks and metal loops don't allow for quick attachment systems to be quickly aligned due to difficulty of rotation and alignment and are susceptible to binding with one another.

SUMMARY

Disclosed is a wheel system, kit and method for a disposable curtain system or other hanging slidable devices. An advantage is the ability to quickly attach a disposable curtain system to a pre-existing or installed curtain system.

Another advantage is the ability to quickly attach a disposable curtain system to a pre-existing or installed track.

Another advantage is during installation, there will be no or minimal need for health care personnel to climb on ladders or stools to reach the hooks for replacement of the curtains.

Another advantage is that health care personnel will not need to crimp the hooks used on pre-existing wheel systems.

Another advantage is removal and disposal and or recycling of the curtains on a regular basis.

Another advantage is that the quick release and lock system may be usable by an installer/disassembler at approximately a height of 6-7 feet for easy installation and removal, it will have disposable curtain attachments that quickly attach and detach with a single or small number or movements during installation and disassembly.

Another advantage is the current system makes it possible to remove the end from a track and install the wheel system with the elongate member or extension and quick-release all at once. In the case of replacement, the old rollers or wheels merely need to be removed.

Another advantage is that with a link, releasably attached to an end cap, the length of the elongate member or extension may be easily changed.

Another advantage is that an end cap may rotate so that it need not align with the direction of the quick-release connectors because the connection between the link and the end cap may swivel or rotate.

Another advantage is that wheel system may rotate so that it need not align with the direction of the quick-release connectors because the connection between the link and the wheel system may swivel or rotate.

Another advantage is that the link is releasably attached at the wheel system and at the end cap so that either the wheel system or the extension or quick release may be quickly detached and replaced.

Another advantage is that the wheel system is dimensioned for multiple tracks thus reducing the number of wheel systems and installer must carry to fit into various tracks.

Another advantage is having a wheel system that will easily glide along the track and not bind up with hooks from nearby wheel systems.

Another advantage is that a kit with multiple wheel sizes, carriage sizes, wheel angles may be provided so that an installer may easily install the wheels without the need for finding the proper fit for the track. Another advantage is that the wheel systems may be easily interchanged based upon the size of the track.

Accordingly, various embodiments of the invention disclosed include: Accordingly, provided is a wheel system, for use with a track, said wheel system comprising: a wheel carriage; a set of wheels, attached to the wheel carriage; a link, having a first end, releasably attached to the wheel carriage and a second end releasably attached to an extension.

Accordingly, further embodiments of the invention provide a kit, wherein the kit includes a wheel system comprising at least two sets of wheel systems. The wheel systems have wheels with axes at different angles with respect to each other. The wheel systems have wheels of different sizes. The wheel systems are interchangeable. The wheel systems have different sized wheel carriages.

Accordingly, various embodiments of the invention disclosed include: A wheel system, for use with a track, said wheel system comprising: a wheel carriage; a set of wheels, attached to the wheel carriage; a link, having a first end, operatively attached to the wheel carriage; wherein angles of the wheels and the width of the wheel carriage are sized to fit into multiple sizes of tracks.

Accordingly, various embodiments of the invention disclosed include: A method for attaching a disposable curtain system comprising: providing a track; preassembling a wheel system having: a wheel carriage, wheels attached to the wheel carriage; a link, having a first end releasably attached to the wheel carriage; and an extension releasably attached to a second end of the link; inserting an end connector into an extension or a quick release system, inserting the preassembled wheel system onto the track; and attaching the curtain using a curtain attachment to the quick-release system.

Accordingly, various embodiments include a wheel system, for use with a track, said wheel system comprising: a wheel carriage, wherein the wheel carriage includes axles and an opening; a set of wheels, attached to the axles of the wheel carriage; a ball-chain link having a plurality of linked balls, wherein a ball on a first end is releasably inserted into the opening of the wheel carriage, wherein the opening of the wheel carriage has slot for receiving a line or wire between the ball of the first end of the ball-chain and the adjacent ball to the ball on the first end of the ball-chain, and a ball on a second end of the ball-chain link is releasably inserted into an opening of an extension, wherein the opening of the extension has slot for receiving a line or wire between the ball of the second end of the ball-chain and the adjacent ball to the second end of the ball-chain.

BRIEF DESCRIPTION

Some of the embodiments will be described in detail, with reference to the following figures, wherein like designations denote like members, wherein.

DETAILED DESCRIPTION

Figure 1:
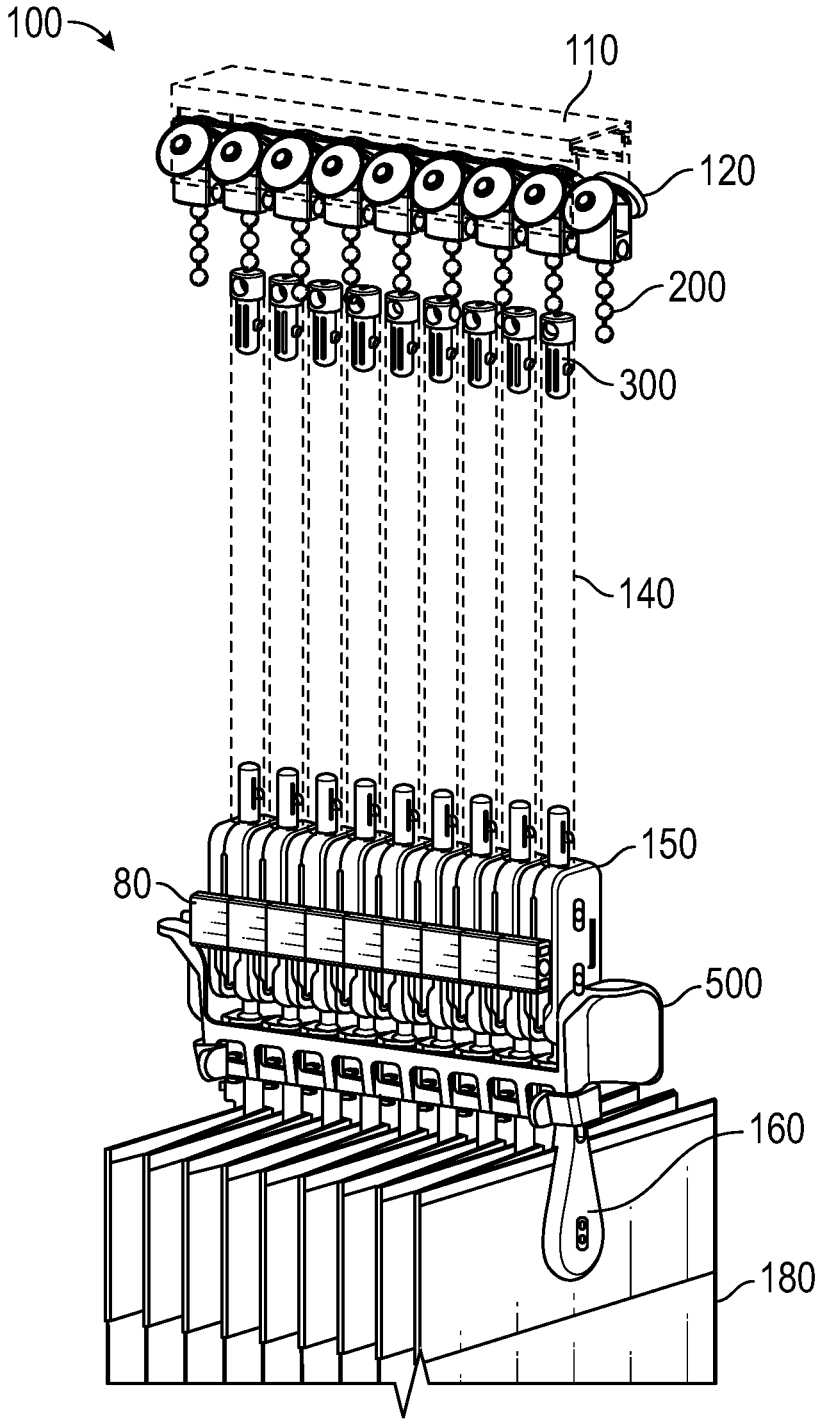
FIG. 1 shows a wheel system as part of a curtain hanging system according to an embodiment of the invention.

Disclosed are various embodiments of the inventions. Referring to FIG. 1 is a disposable curtain system 100. The disposable curtain system 100 is attached to the ceiling by a track 110. The track may be attached directly to the ceiling or hang from the ceiling on extensions. Running through the track 110 are wheel systems 120. The roller hooks or rollers or wheels with attachments have a link 200 on the end thereof for attaching an extension or elongate member or extension 140. The link 200 may be any connector, ball chain, bead, retaining chain, clip, clasp, chain link, catch, snap, hook, safety pin, buckle metal loop, shackle, eyelet, grommet, carabiner, spring hook or any other attachment means or connector interposed between the wheel system an the end cap or extension or quick release and having a releasable attachment and adapted so that the extension or end cap or quick release does not come off the wheel system 120.

The extension 140 may be telescoping poles, poles that may be discreet sizes and interchanged depending on size needed, straps which may include a buckle that may be adjusted for size or the strap may be cut, a string, cable or wire that may be adjusted or cut. Since the extension will remain in place it is important that is easily cleanable for infectious diseases with an extension pole that has disinfectant. The material of the extension should not absorb liquids but should be made from a nonabsorbent plastic such as polyvinyl, acrylic, polyacrylic, nylon, carbon composite, PVC, polyethylene or the like.

The curtain 180 comes in discreet sections, such as 6-12 feet and most commonly 9 feet. The curtain discreet sections of 9-12 feet may be snapped together with snaps so as to make longer curtains. The curtains are made from disposable recyclable material such as polypropylene. Alternatively, the curtains may be made of cloth for quick change for washing.

The curtains 180 may be attached to the extension 140 with a quick-release mechanism 150 and a curtain attachment assembly or curtain attachment 160. The curtain attachment has a locking mechanism 80. The curtain attachment 160 during shipping and the initial assembly may be held together with a zip-tie, twist tie 90 or a holder such as 500 shown in FIG. 1.

Figure 2A:
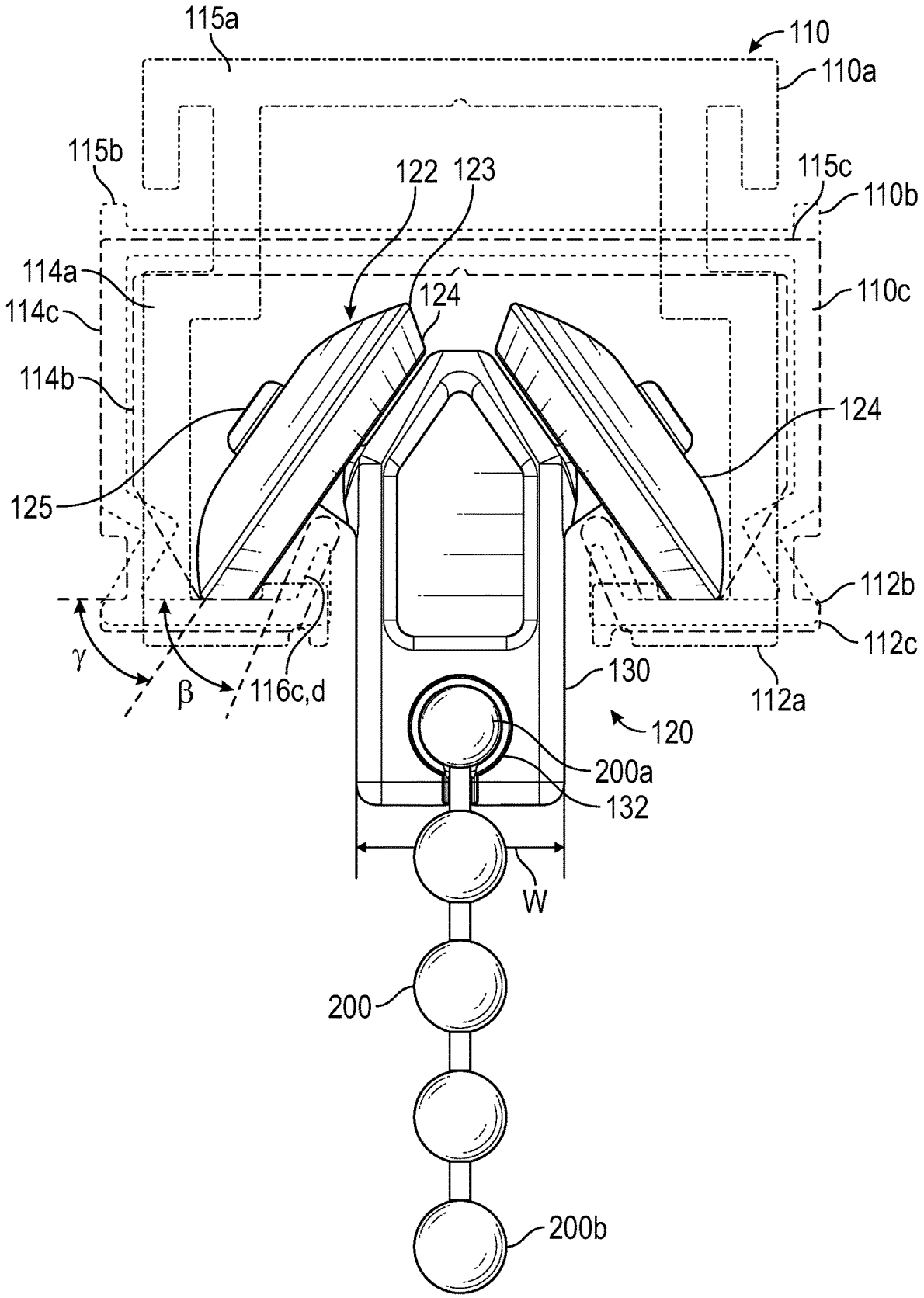
FIG. 2A shows a front view of dimensioning a wheel system according to a first embodiment of the invention having multiple tracks overlayed.
Figure 2B:
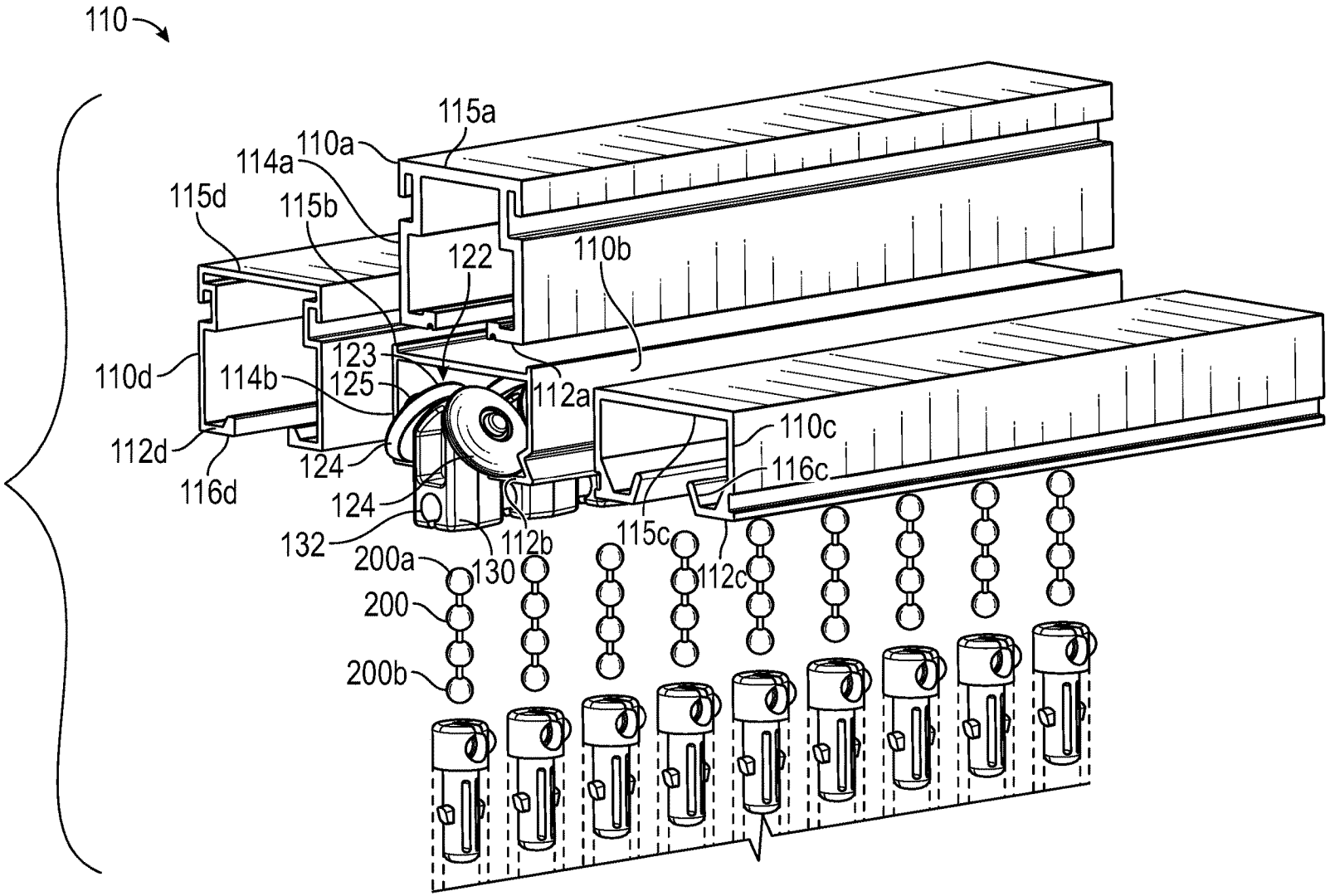
FIG. 2B shows a front view of dimensioning a wheel system according to a first embodiment of the invention having multiple tracks in an exploded view.

Referring to FIG. 2, a track(s) 110 are shown. The track(s) 110 is bolted, screwed, glued or otherwise attached to the ceiling. The track may also be on a hanging system and hang from the ceiling. The track 110 has an end piece (not shown) with snap connectors for the end piece. Running inside the track are roller hooks or rollers with wheel systems 120 having guide, rollers or wheels 122, 124. Additionally, other types of arrangements other than rollers or wheel systems 120 may be used so long as the slide easily along the track guides 118 such as slides, balls, or the like. Extending from the rollers or wheels are a link 200, i.e. a ball chain which is inserted for ease of replacement in an opening or bore 132.

Figure 7:
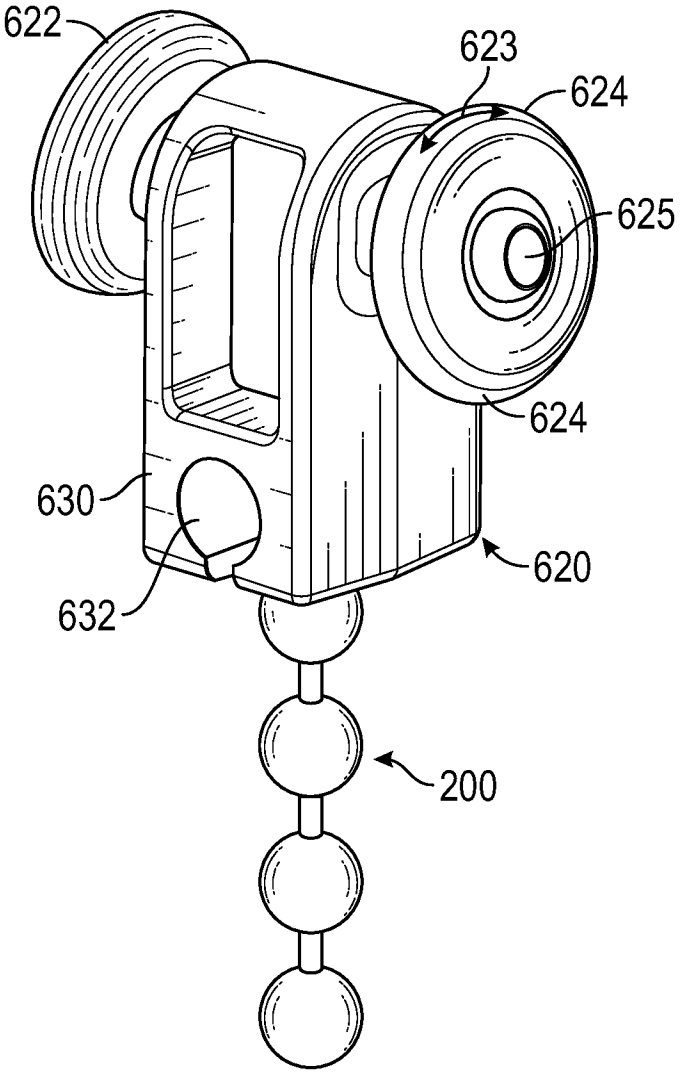
FIG. 7 shows a second embodiment of a perspective view of a wheel system according to a second embodiment of the invention.

The tracks 110 shown in FIG. 2 is actually a representation of a graphic drawing of four tracks overlain to arrive at a proper wheel angle and size and a wheel carriage 130 size. A first track 110*a* has a base track 112*a*, a side of track 114*a* and both sides and a top of track 115*a*. A second track 110*b* has a base track 112*b*, a side of track 114*b* and both sides and a top of track 115*b*. A third track 110*c* has a base track 112*c*, a side of track 114*c* and both sides and a top of track 115*c*. A fourth track 110*d* has a base track 112*d*, a side of track 114*d* and both sides and a top of track 115*d*. The tracks 110*a-d* are overlain and engineering calculations are made to obtain a width w of the wheel carriage 130. In addition, angle β, the angle between base of tracks 112*a*, 112*b*, 112*c*, 112*d* and track angle 116*c,d* is calculated. Each guide, roller or wheel has a circumference 123 and a wheel axle 125. In order so that the roller, guide or wheel 122 rotates smoothly in the track the inner contact surface 124 must be angled, inclined, rounded, flattened or tilted with respect to the base 112*a-d* so as to ride evenly on the base of all the base tracks 112*a*, 112*b*, 112*c*, 112*d* using angle γ, the angle between base of track 112*a*, 112*b*, 112*c*, 112*d* and circumference of guide, roller or wheel 123. In this case, the inner contact surface 124 is parallel or rides evenly upon the base of the track 112*a-d*. In FIG. 7, the inner contact surface 624 is rounded so as to ride evenly on the base. As shown, the angle γ must be such that the wheels 122 will not be hindered or rub on either the track angle 116*c* or 116*d*. If calculations are not made and accurately tested, an installer will need to carry multiple wheel systems depending upon the track used. This wheel system 120 only requires a single type or reduced number of wheels 122 to fit into one of four different tracks. Furthermore, wheel system 620 can fit into multiple tracks. Thus, using three wheel systems 120, 620 and 820 at least seven different tracks may be accommodated using only three wheels, whereas seven were needed in the past. The wheel system 120 is for use with a track 110, said wheel system 120 comprising: a wheel carriage 130, a set of wheels 122, 124 attached to the wheel carriage 130; a link 200, having a first end 200*a*, operatively attached to the wheel carriage 130 in slotted opening 132; wherein angles γ, β of the wheels and the width of the wheel carriage w are sized to fit into multiple sizes of tracks. The angles γ, β of the wheels and the width of the wheel carriage w are sized by overlaying multiple tracks in a design drawing and arriving at dimensions based upon overlaying multiple tracks.

Figure 3:
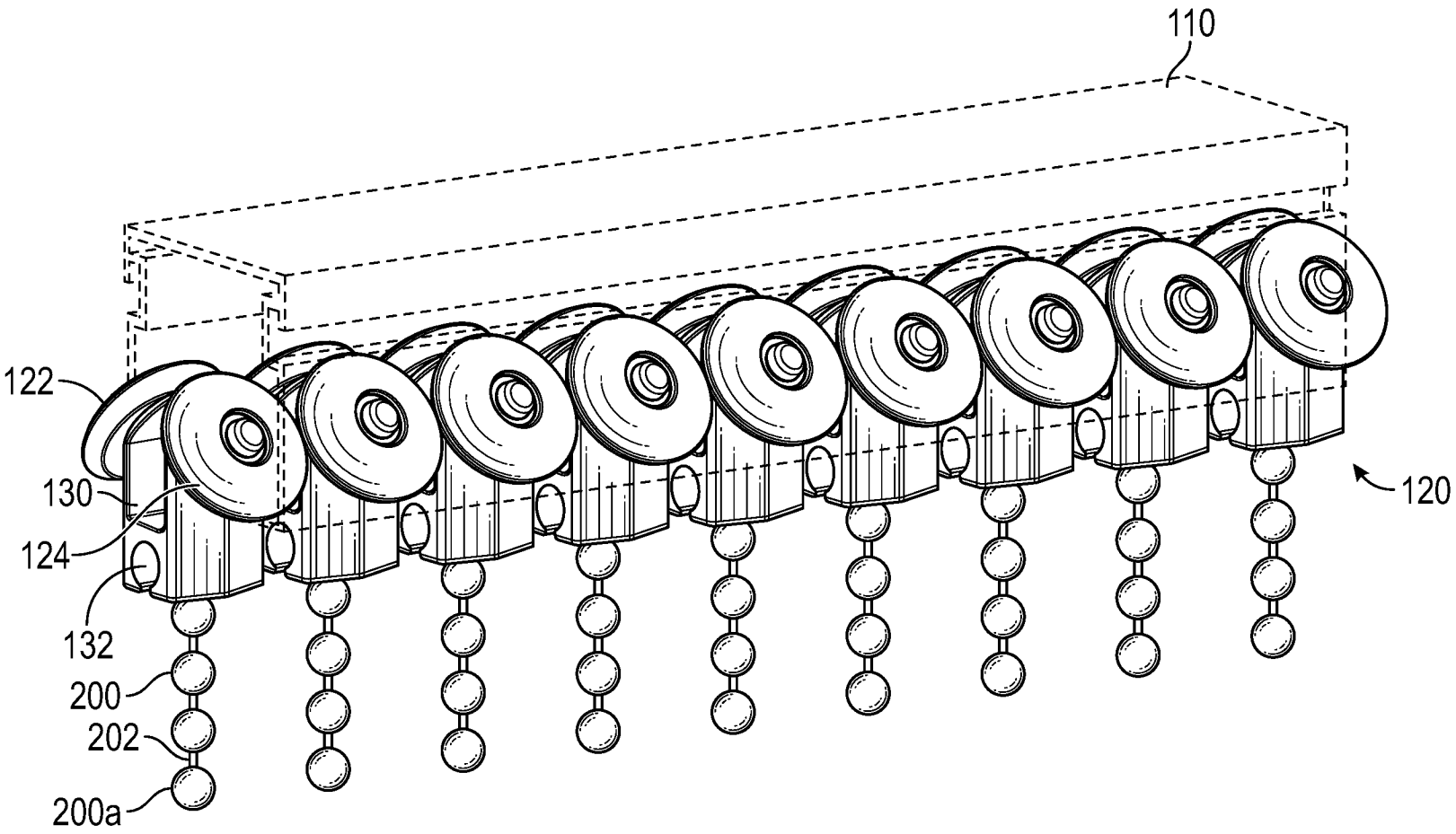
FIG. 3 shows a front and side perspective view of a wheel system according to a first embodiment of the invention.

FIG. 3 illustrates track 110 with multiple wheel systems 120 having wheels, guides or rollers 122, wheel carriages 130, links 200.

Figure 4:
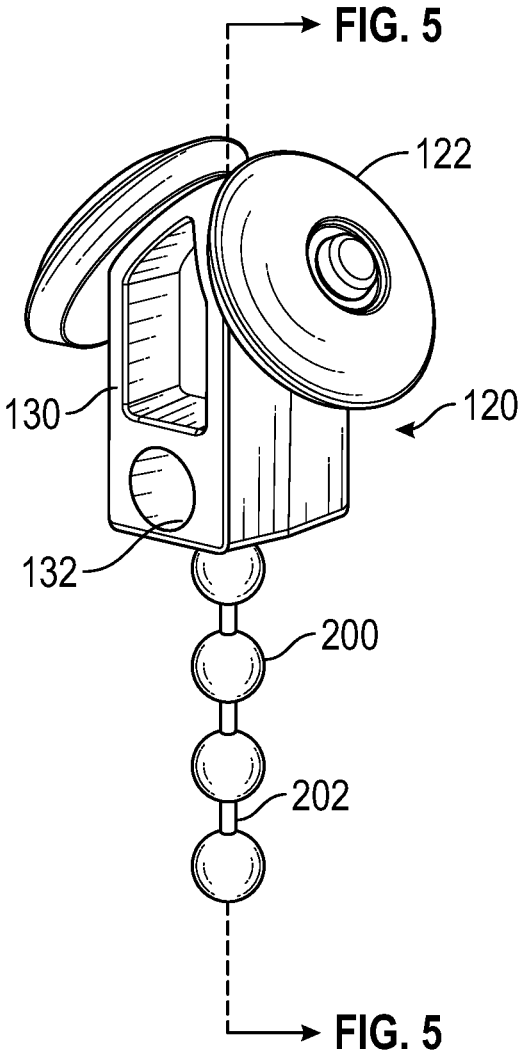
FIG. 4 shows a front and side perspective view of a wheel system (without end cap) according to a first embodiment of the invention.

FIG. 4 shows a perspective view of a single wheel system 120. The links 200 may be balls 200*a* having lines or wires 202 therebetween. The link 200 may be any connector, ball chain, bead, retaining chain, clip, clasp, chain link, catch, snap, hook, safety pin, buckle metal loop, shackle, eyelet, grommet, carabiner, spring hook, wire loop, wire with attachments on the end such as beads or balls, or any other attachment means or connector interposed between the wheel system an the end cap or extension or quick release and having a releasable attachment and adapted so that the extension or end cap or quick release does not come off the wheel system 120.

Figure 5:
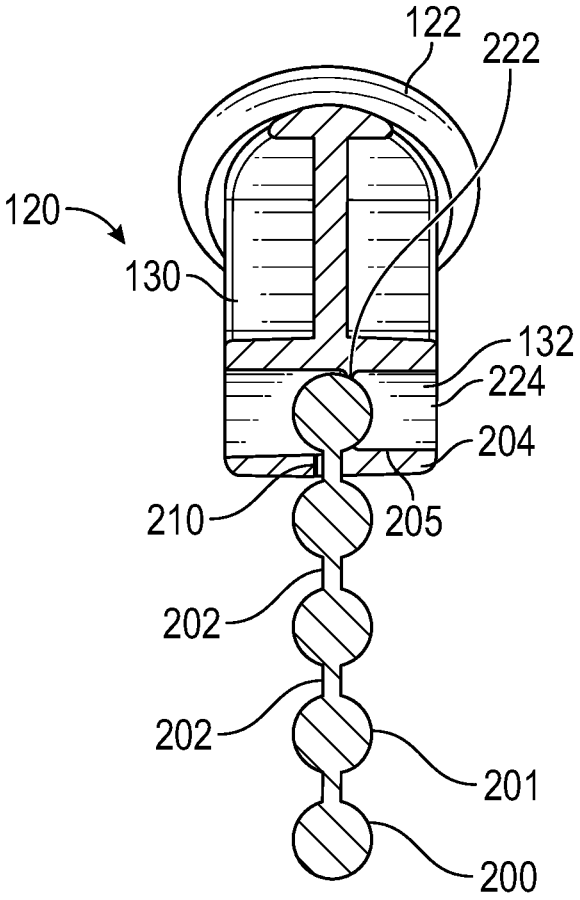
FIG. 5 shows a side perspective view of a wheel system through 5-5 according to a first embodiment of the invention.

Line 5-5 shows the cutaway of FIG. 5. FIG. 5 shows a cutaway of the wheel system 120 showing the guide roller or wheel 122, the wheel carriage 130, the link 200 or ball chain having balls 201 and line or wire 202. Within the slotted opening 132 is a slot 204, a back wall 210, a nib 222 and a cylindrical opening 224. The cylindrical opening is a connector for attaching another connector ball 200*a* therein. During use a ball 200*a* of the ball chain is placed into the opening 132 and slid along until it engages the nib 222. The cylindrical opening has a first diameter 224 and the nib 222 has a second diameter 222 so that the ball 202 must be press fitted over the nib 222 to engage and be held in the center of the opening. The nib 222 is tapered so that during the press fit, the ball 200 may be slid over the nib 222 to be held in place.

Figure 6:
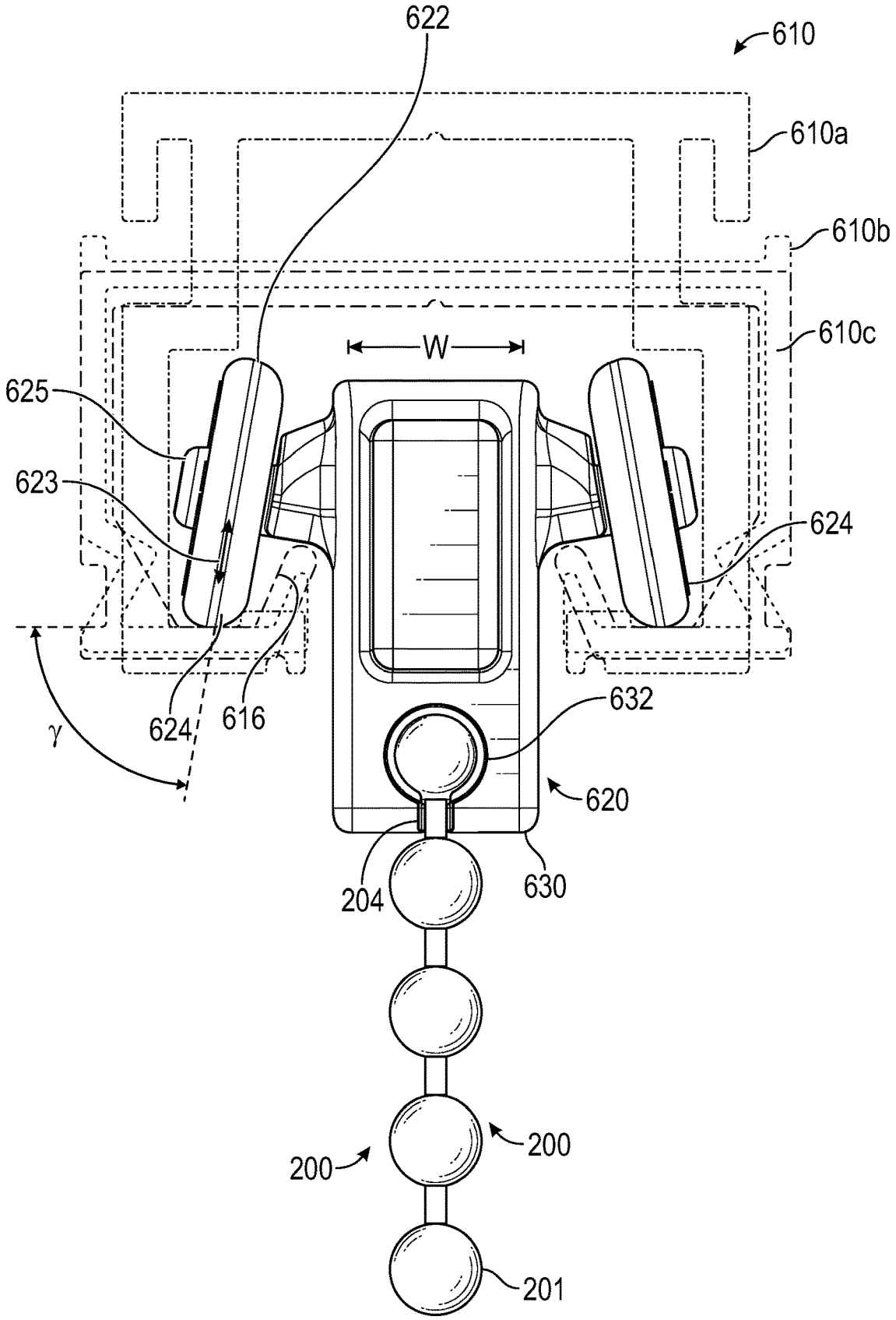
FIG. 6 shows a front view of dimensioning a wheel system (without end cap) in overlayed track systems according to a second embodiment of the invention.

FIGS. 6 and 7 shows an alternate embodiment which a track system 610. The track 610 shown in FIG. 6 is actually a representation of a graphic drawing of 3 tracks 610*a*, 610*b*, 610*c* overlain to arrive at a proper wheel angle and size and a wheel carriage 630 size. The tracks 610*a-c* are overlain and engineering calculations are made to obtain a width w of the wheel carriage 130. In addition, angle δ, the angle between base of tracks 610*a*, 610*b* and 610*c* and wheel circumference 622 is calculated. Each guide, roller or wheel has a circumference 623 and a wheel axle 625. In order so that the roller, guide or wheel 622, 624 rotates smoothly in the track the inner contact surface 124 must be angled to ride evenly on the base of all the base tracks 610*a*, 610*b*, 610*c* using angle δ, the angle between base of track 610*a*, 610*b*, 610*c* and circumference of guide, roller or wheel 123. If calculations are not made and accurately tested, an installer will need to carry multiple wheel systems depending upon the track used. This wheel system 620 only requires a single type of wheel 622 to fit into one of three different tracks.

Figure 8:
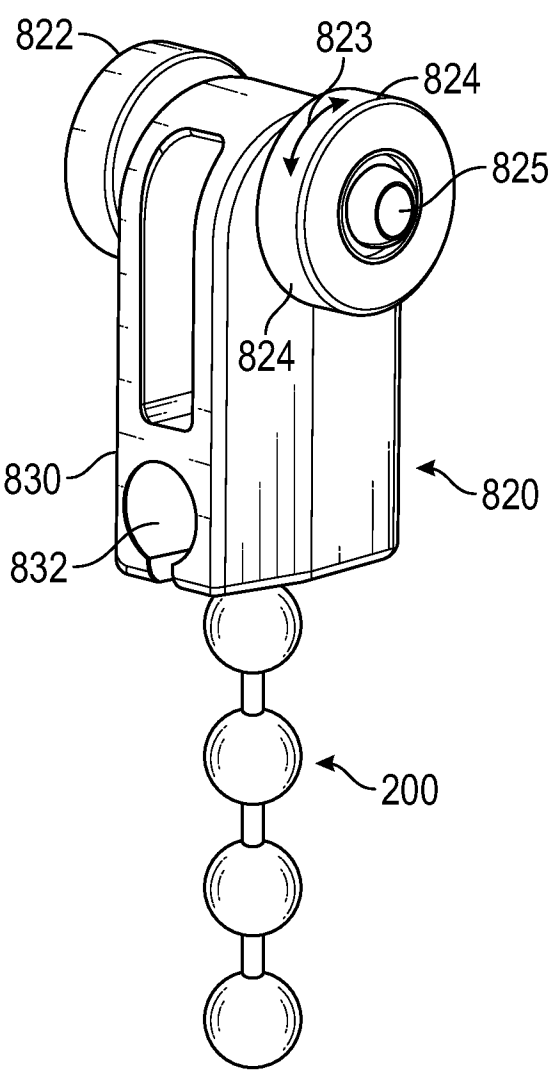
FIG. 8 shows a perspective view of a wheel system (with end cap) according to third embodiment of the invention.

FIG. 8 shows a third embodiment of a wheel system 820. In certain instances, a wheel is dimensioned so that it may not fit into any track. In this case the wheels 822 and 824 are small. The wheels 822 and 824 have a wheel axle 825. The wheels are positioned on a carriage 830 and have an opening 832 for receiving the link 200.

Figure 9:
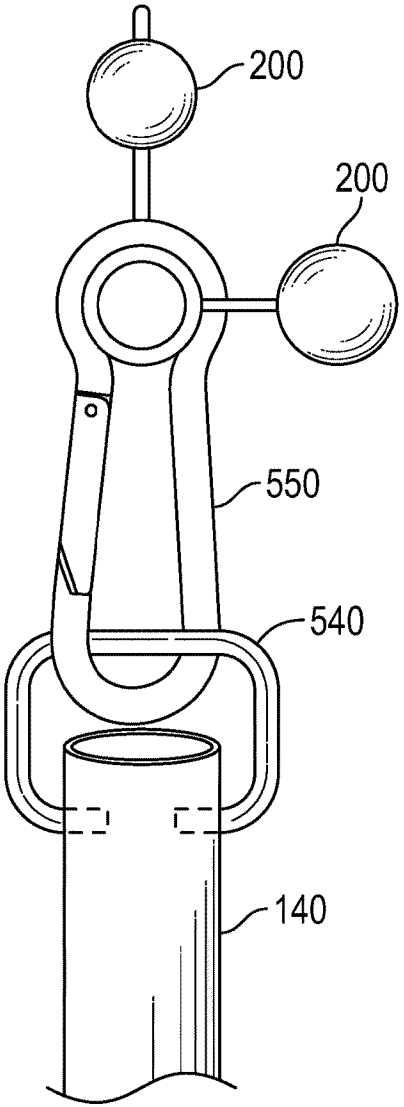
FIG. 9 shows an attachment without endcap according to an embodiment of the invention.

FIG. 9 shows a first type of link 200 attachment to an extension 140 or quick connect (not shown). The extension 140 has a wire loop that is attached thereto. The wire loop 540 is attached to the link 200 via a clasp or clip 550 through the wire loop 540. In this instance, a wheel system 120 is attached for use with a track 110, said wheel system comprising: a wheel carriage 130; a set of wheels 122, 124, attached to the wheel carriage 130; an extension connector 540 or wire loop is adapted to be attached to curtain hanging system such as the extension or quick connect. A link 200, having a first end, releasably attached to the wheel carriage 130 and a second end releasably attached to an extension 140 using clip or clasp 540.

Figure 10:
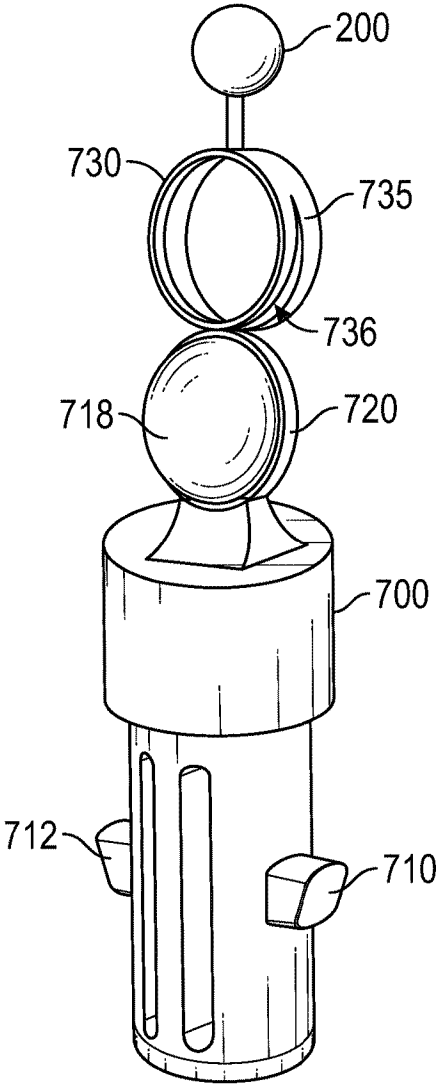
FIG. 10 shows a first embodiment of an end cap of an embodiment of the invention.

FIG. 10 shows an alternate embodiment of the invention. In FIG. 10 is shown an end cap 700 having a solid circular plastic portion 718 molded therewith. The plastic portion 718 is solid and has a groove 720 therein for mating with corresponding springed circular openings 720, 735. A slot 736 is cut into the circular springed openings 720, 735 and will engage the groove 720. The circular springed openings are attached to the link 200.

Figure 11:
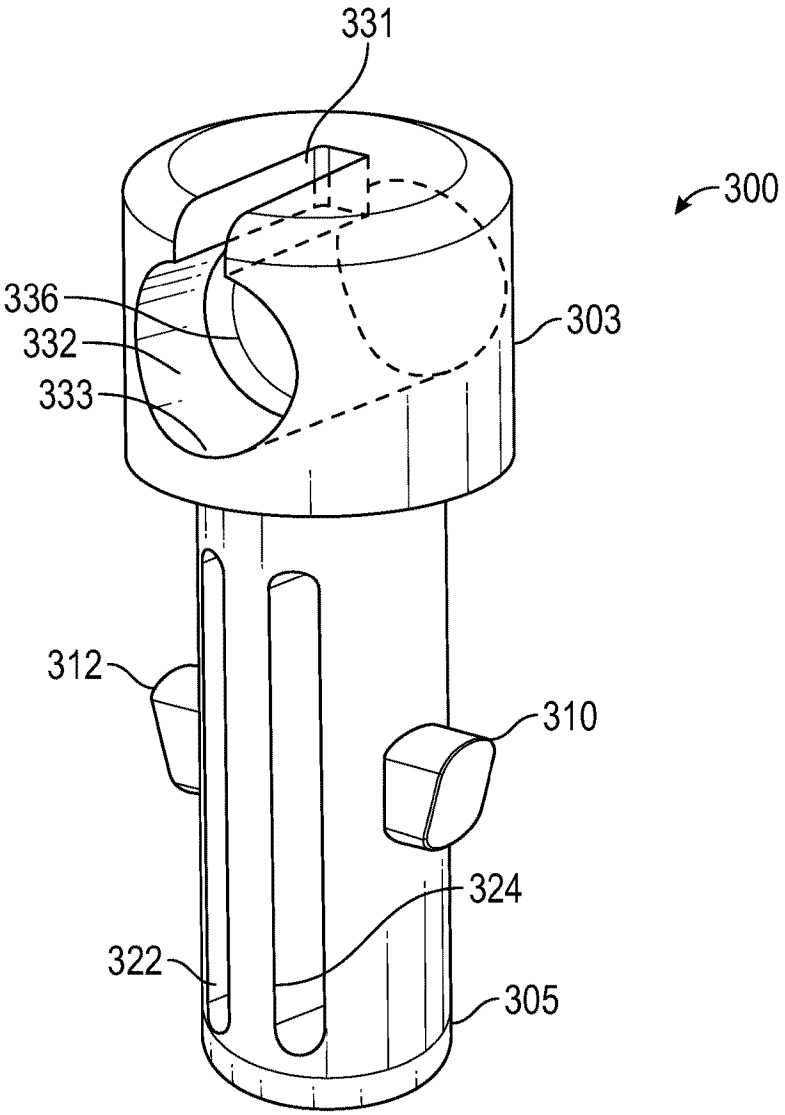
FIG. 11 shows a second embodiment of an end cap of an embodiment of the invention.

FIG. 11 shows another embodiment of an end cap 300. This end cap 300 includes a cylindrical portion 305 for engagement with one of an extension 140 or a quick release system 150, said cylindrical portion 305 further including a catch 310, 312 for attachment to the extension 140; and a cap 303, extending from said cylindrical portion 305, said cap 303 having a connector 333 for attaching to a wheel carriage 130. The catch 310, 312 is a plurality of protrusions, wherein the plurality of protrusions are tapered along an axis of the cylinder 305, said plurality of protrusions 310, 312 adapted for engaging with openings within the extension. The cylindrical member 305 has a plurality of slots 322, 324 therein for allowing the plurality of extensions 310, 312 to flex and engage the openings within the extension. The cap 303 has a connector which includes a slotted opening 332 having a first diameter and a second diminished diameter at a nib 336 for engaging and releasably attaching a ball chain on a link 200.

Figure 12:
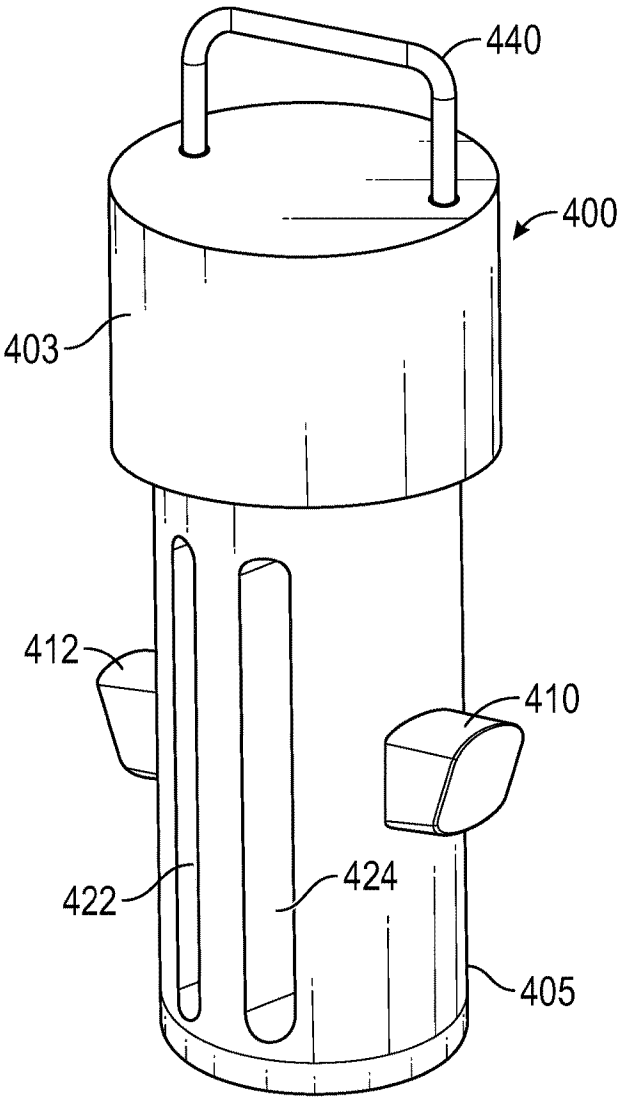
FIG. 12 shows a third embodiment of an end cap of an embodiment of the invention.

Referring to FIG. 12, the connector of the cap 400 includes an eyelet or a handle 440 and has protrusions or catch 410, 412 and slots 422 and 424 on cylindrical body 405.

Figure 13:
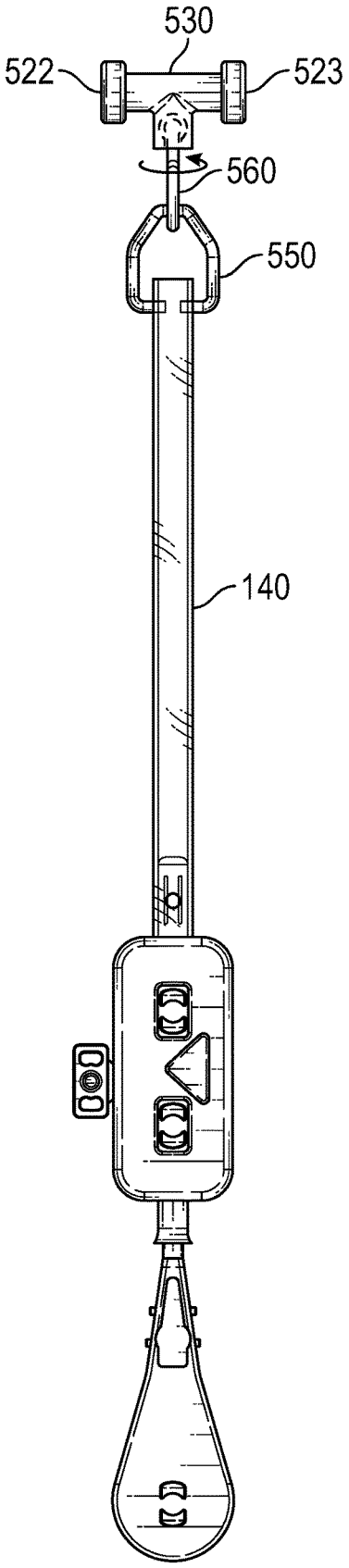
FIG. 13 shows a front side of an embodiment of an attachment of a wheel system.
Figure 14:
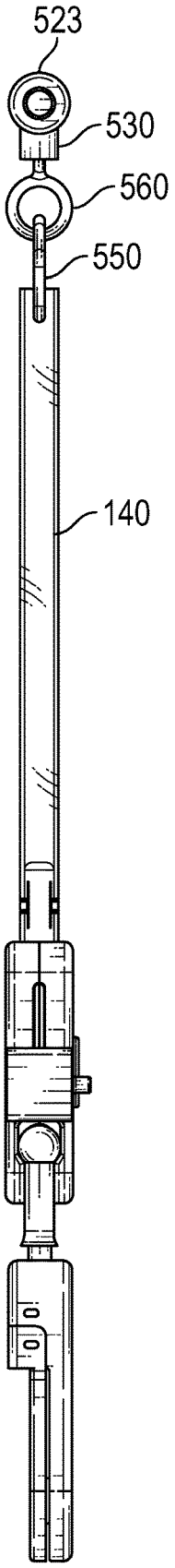
FIG. 14 shows a side view of the embodiment of FIG. 13 of an attachment of a wheel system.

Referring to FIGS. 13 and 14, a wheel system is shown with a link or eyelet 560 and wire clip or clasp 550. The clip or clasp 550 attaches to an extension 140. Holes are drilled into the extension 140. The portion of the eyelet 560 that attaches to the wheel carriage 530 having wheels 522 and 523.

Figure 15:
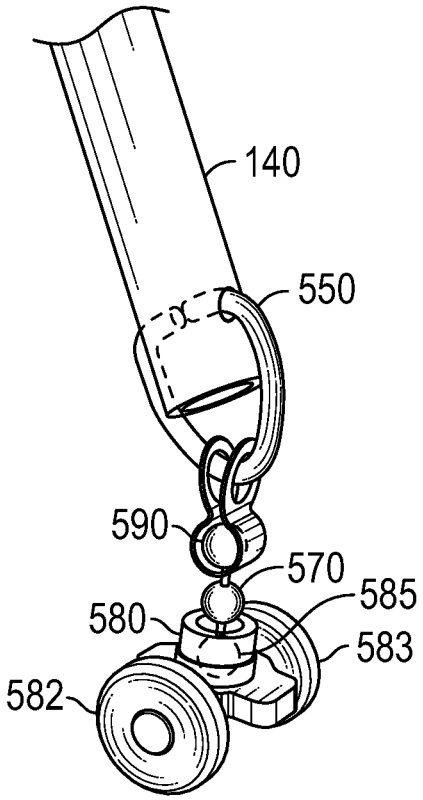
FIG. 15 shows another embodiment of an attachment of a wheel system.

FIG. 15 shows an alternate wheel system. The wheel carriage 580 includes wheels 582 and 583. The wheel carriage 580 is attached to a ball chain 570. One of the balls 585 on one side is encased within the wheel carriage 580. The opposite side ball is attached to a ball clip 590 which is attached to a wire clip or clasp 550 which is attached to an extension 140.

Figure 16:
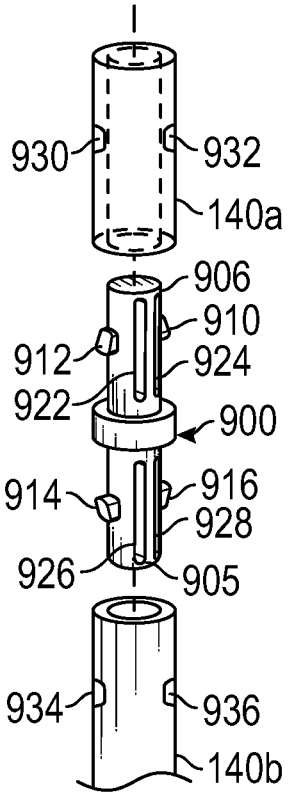
FIG. 16 shows an extension attachment for attaching two extensions together.

FIG. 16 shows an extension connector 900. The connector assists in connecting extensions 140*a* and 140*b*. The extensions 140*a* and 140*b* have holes 930, 932 and 934, 936 which engage with catches 910, 912, 914 and 916. The catches 910, 912, 914 and 916 are tapered so as to allow the catches to slide into the holes 930, 932, 934 and 936 when the ends 905 and 906 are inserted into the rods or extensions 140*a*, 140*b*. The connector has material removed at 922, 924, 926 and 928 to allow the connector to flex. The advantage of the extension connector 900 is so that the length of the entire extension may be changed by adding or decreasing extensions 140*a*, 140*b*. For example if an installer enters into a facility for installation with 24 inch rods or extensions 140*a*, 140*b* and discovers a room that needs 36 inch rods rods or extensions. The installer may add 12 inches to the 24 inch rods or extensions to arrive at 36 inch rods or extensions.

A method for attaching a disposable curtain system is also disclosed. The method is performed by providing a track 110. Next is the step of preassembling a wheel system 120 having a wheel carriage 130, wheels 122, 124 are attached to the wheel carriage 130. A link 200, having a first end 200*a* releasably attached to the wheel carriage 130*e*; and an extension 140 releasably attached to a second end of the link 200*b*. The step of inserting an end connector such as an end cap 300, 400 or a clip or clasp 550 with wire loop 540 into an extension 140 or a quick release system 150. The wheel system 130 is inserted onto the track; and attaching the curtain 180 using a curtain attachment 160 to the quick-release system 150.

In the method, the extension 140 has a first end attached to an end cap 300, 400, 700 and a second end attached to the quick release system 150.

The method further comprising: providing an end cap 300, 400, 700 with a cylindrical portion 305, 405 for engagement with the extension 140 or quick release 150, said cylindrical portion 305, 405 further including a catch 310, 312 or 310, 412 for attachment to the extension 140; and a cap 303, extending from said cylindrical portion 305, said cap 303 having a connector 332 for attaching to a wheel carriage 130; and the step of inserting the end cap 300, 400 further comprises inserting the cylindrical end 305, 405 into an extension 140 or a quick release system.

The end caps 300, 400, 700 and wheels systems are all made using injection molded parts using materials such as thermoplastic or thermosetting polymers, elastomers or metals. Common polymers like epoxy and phenolic are examples of thermosetting plastics which nylon, polyethylene and polystyrene are thermoplastic or acetyl plastics.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

What is claimed is:

1. A wheel system, for use with a track, said wheel system comprising:

a wheel carriage, wherein the wheel carriage includes axles and an opening;

a set of wheels, attached to the axles of the wheel carriage;

a ball-chain link having a plurality of linked balls, wherein a ball on a first end of the ball-chain link is releasably inserted into the opening of the wheel carriage using a press fit wherein the ball on the first end is press fit over a nib and retained by the nib, wherein the opening of the wheel carriage has slot for receiving a line or wire between the ball of the first end of the ball-chain link and the adjacent ball to the ball on the first end of the ball-chain link, and wherein a ball on a second end of the ball-chain link is releasably inserted into an opening of an extension connector or an end cap extending from an end of a rod, wherein the opening of the extension connector or end cap has a slot for receiving a line or wire between the ball of the second end of the ball-chain link and the adjacent ball to the second end of the ball-chain link, wherein the extension connector or end cap has a cylindrical opening adapted to receive the ball of the second end of the ball-chain link, wherein the cylindrical opening includes a first diameter for receiving the ball of the second end of the ball-chain link and a second diameter or reduced diameter for engaging and releasably retaining the ball of the second end of the ball-chain link.

2. The wheel system of claim 1 wherein the rod is a hollow rod made of one of nylon, acrylic or other polymer.

3. A kit, wherein the kit comprises:

the wheel system as claimed in claim 1, and a second wheel system.

4. The kit of claim 3, wherein the first wheel system has wheels with a first axle angle and the second wheel system has wheels with a second axle angle, wherein the second axle angle is different from the first axle angle.

5. The kit of claim 3, wherein the first wheel system has wheels of a first size and the second wheel system has wheels of a second size, wherein the second size is different from the first size.

6. The kit of claim 3, wherein the first wheel system and the second wheel system are wheel systems that are different and the different wheel systems are interchangeable.

7. The kit of claim 3, wherein the first wheel system and the second wheel system have different sized wheel carriages.

8. The wheel system of claim 1, wherein the rod is a hollow tube and the extension connector or the end cap has a cylindrical portion which is inserted into the hollow tube or rod.

9. The wheel system of claim 1, wherein the opening of the wheel carriage has a first diameter and the nib in the opening has a second diameter so that the ball on the first end of the ball-chain link must be press-fitted over the nib to engage and be held in the center of the opening.

10. The wheel system of claim 1, wherein the nib is tapered so that the ball on the first end of the ball-chain link may be slid over the nib to be held in place.

11. The wheel system of claim 1, wherein the extension connector or end cap further includes a cylindrical portion for engagement with one of an extension or a quick release system, said cylindrical portion further including a catch for attachment to the extension or quick release, wherein said catch is a plurality of protrusions tapered along an axis of the cylinder, including at least one protrusion adapted for engaging with openings within the extension.

12. A wheel system, comprising:

a wheel carriage, wherein the wheel carriage includes axles and an opening;

a set of wheels, attached to the axles of the wheel carriage;

a ball-chain link having a plurality of linked balls, wherein a ball on a first end of the ball-chain link is releasably inserted into the opening of the wheel carriage using a press fit wherein the ball on the first end is press fit over a nib and retained by the nib, wherein the opening of the wheel carriage has a slot for receiving a line or wire between the ball of the first end of the ball-chain link and the adjacent ball to the ball on the first end of the ball-chain link, and wherein a ball on a second end of the ball-chain link is releasably inserted into an opening of an extension connector or an end cap extending from an end of a rod, wherein the extension connector or end cap includes an opening sized for receiving the ball on the second end of the ball-chain link, wherein said opening is cylindrical and has a length and a diameter and further comprises a nib for holding the ball on the second end of the ball-chain link, wherein said nib reduces the diameter of the cylinder as compared to the opening for receiving the ball on the second of the ball-chain link, wherein the opening of the extension connector or end cap has a slot for receiving a line or wire between the ball of the second end of the ball-chain link and the adjacent ball to the second end of the ball-chain link.

13. The wheel system of claim 12, wherein the set of wheels is interchangeable with a second set of wheels.

* * * * *